US007637439B1

(12) United States Patent
Highsmith et al.

(10) Patent No.: US 7,637,439 B1
(45) Date of Patent: Dec. 29, 2009

(54) SAFETY DRINKING STRAW

(76) Inventors: Maurice Highsmith, 6309 Carlisle Sq., Apt. 103L, Virginia Beach, VA (US) 23464; Gevoice Highsmith, 6309 Carlisle Sq., Apt. 103L, Virginia Beach, VA (US) 23464

( * ) Notice: Subject to any disclaimer, the term of this patent is extended or adjusted under 35 U.S.C. 154(b) by 241 days.

(21) Appl. No.: 11/472,123

(22) Filed: Jun. 21, 2006

(51) Int. Cl.
*A47G 21/18* (2006.01)

(52) U.S. Cl. ..... 239/33; 239/24

(58) Field of Classification Search ..... 239/24, 239/33, 600; 604/77, 85, 79
See application file for complete search history.

(56) References Cited

U.S. PATENT DOCUMENTS

| | | | | | |
|---|---|---|---|---|---|
| 2,063,803 | A * | 12/1936 | Gildersleeve | ..... | 239/33 |
| 2,619,770 | A * | 12/1952 | Dinhofer | ..... | 239/33 |
| 2,943,794 | A * | 7/1960 | Sussman | ..... | 239/33 |
| 3,409,224 | A * | 11/1968 | Harp et al. | ..... | 239/33 |
| 3,425,626 | A * | 2/1969 | Dietz et al. | ..... | 239/33 |
| 3,517,884 | A * | 6/1970 | Horvath | ..... | 239/33 |
| 4,773,898 | A * | 9/1988 | Begouen | ..... | 604/79 |
| 4,889,044 | A | 12/1989 | Rosenfield | | |
| 5,718,681 | A * | 2/1998 | Manning | ..... | 604/85 |
| 6,585,170 | B2 | 7/2003 | Katsukawa | | |
| D491,336 | S | 6/2004 | Cecere | | |
| 6,929,191 | B2 * | 8/2005 | Kim | ..... | 239/33 |
| 2003/0132307 | A1 | 7/2003 | Park | | |

* cited by examiner

*Primary Examiner*—Steven J Ganey
(74) *Attorney, Agent, or Firm*—David L. Banner

(57) ABSTRACT

A safety drinking straw has an elongated, hollow body having a loop formed at its top end, the loop having an orifice through which liquid may pass. The size of the orifice controls the maximum liquid flow rate thereby preventing excessive liquid to be ingested. The smooth contour of the loop prevents injury to the mouth or lips. The size of the loop prevents its insertion into the mouth, thereby preventing both choking and possible injury to the mouth or throat. In addition, the open configuration of the upper loop makes it easy to grasp by a young child with not yet developed fine motor skills or by an adult having a disorder that effects small motor movements of the hand. A strainer disposed at the bottom, distal end of the straw prevents ingestion of seeds or other particles possibly present in the liquid being consumed through the straw.

8 Claims, 3 Drawing Sheets

SAFETY DRINKING STRAW

FIELD OF THE INVENTION

The invention pertains to drinking straws and, more particularly, to a safety straw useful for protecting infants, toddlers, and other users.

BACKGROUND OF THE INVENTION

Drinking straw are ubiquitous and provide many advantages to persons who for reasons of age or infirmity are unable to hold or properly tip a cup or glass so as to drink the contents thereof. However, there are also well known safety issues with the well-known, widely used drinking straws of the prior art. For example, mass-produce, disposable straws may have relatively sharp edges that may inflict injury to the mouth of a user. The sharp edges are the result of a common mass production technique wherein long lengths of hollow straw stock are cut to length using cutting implements such as razor blades or the like. The cutting process often leaves sharp edges at one or both of the upper and lower ends of the straw.

Another problem present in conventional drinking straws of the prior art is that their narrow diameter allows easy insertion of the straw deeply into the mouth of an infant or toddler possibly causing choking or injury to sensitive inner portions of the mouth or throat.

The relatively large diameter of a typical prior art drinking straw may also allow the ingestion of an excessive amount of fluid by an infant or toddler.

Straws of the prior art may be difficult for a young child or other persons having certain disabilities to grasp and manipulate. The thin, tubular cross-section does not readily lend itself to controlled grasping by, for example, a young child with undeveloped small motor skills.

Conventional drinking straws also allow ingestion of small objects, for example seeds, that may be present in the liquid being consumed through the straw. Such objects can also cause choking when caught in a person's throat.

DISCUSSION OF THE RELATED ART

Attempts have been made to remedy some of the aforementioned problems of drinking straws of the prior art. For example, Published United States patent application for BEVERAGE STRAW WITH THERMALLY SMOOTHED TIPS, published Jul. 17, 2003 upon application by Joshua Ji Park provides one solution to the problem of sharp edges in typical cylindrical drinking straws. PARK teaches a process for thermally treating the edges of a straw after cutting to smooth the sharp edge left by the cutting process.

U.S. Pat. No. 4,889,044 for FRUIT JUICE EXTRACTOR, issued Dec. 26, 1989 to Ronald H. Rosenfield teaches a straw having a distal end adapted for insertion directly into the interior of a fruit, typically an orange or other citrus fruit. The ROSENFIELD straw contains an auger-like shape at its distal end. This tip, once inserted into the orange, allows sweeping through the interior of the orange in a weaving type of motion facilitating extraction of the juice from within the orange. Small holes are disposed in the otherwise sealed tip to exclude seeds or other non-juice portions of the orange as the juice is extracted through the straw.

U.S. Pat. No. 6,585,170 for STRAW WITH A MOUTHPIECE AND A METHOD OF MANUFACTURING THE SAME, issued Jul. 1, 2003 to Yoshitaka Katsukawa discloses a straw having an enlarged mouthpiece at its proximal end. The KATSUKAWA mouthpiece has a single, central opening aligned with the major axis of the straw and continuous with the hollow center of the straw.

U.S. Design Pat. No. D491,336 for COMBINATION LOLLIPOP, DRINKING STRAW, issued Jun. 15, 2004 to Al Lewis Cecere shows a design for a straw having a spherical, bulbous portion at the proximal end of a drinking straw. A central opening in the bulbous portion is coaxially aligned with the central opening of the straw.

None of these patents and/or published patent application taken individually, or in any combination, teaches or suggests the novel safety drinking straw of the present invention.

SUMMARY OF THE INVENTION

In accordance with the present invention there is provided a safety drinking straw that overcome all known limitations of drinking straws of the prior art. An elongated, hollow body has a hollow loop formed at its top end. The loop has one or more orifices configured for interaction with the mouth of a drinker and through which liquid may pass. The size of the upper orifice is used to control the maximum liquid flow rate thereby preventing excessive liquid to be ingested at any one time. The smooth contour of the loop prevents injury to the mouth or lips of a user. The diameter of the loop is chosen to disallow insertion of the loop into the mouth, thereby preventing both choking and possible injury to the mouth or throat of a user. In addition, the central opening of the upper loop makes it easy to grasp by a young child with not yet developed fine motor skills or by an adult having a disorder that effects small motor movements of the hand. A strainer disposed at the bottom, distal end of the straw prevents ingestion of seeds or other particles possibly present in the liquid being consumed through the straw.

It is, therefore, an object of the invention to provide a safety drinking straw having an upper portion shaped to prevent insertion into the mouth of an infant or toddler.

It is another object of the invention to provide a safety drinking straw having an orifice in the upper portion designed to limit the flow rate of liquid into the mouth of a user thereof.

It is a further object of the invention to provide a safety drinking straw having means to prevent the ingestion of small particles (e.g., seeds) by the user.

It is an additional object of the invention to provide a safety drinking straw that may be easily grasped and manipulated by a small child or a person with certain disabilities.

It is yet another object of the invention to provide a safety drinking straw having smooth surfaces to prevent injury to the lips or mouth of a user.

It is a still further object of the invention to provide a safety drinking straw having a loop sized to prevent insertion into the mouth of a small child.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

Figure 1:
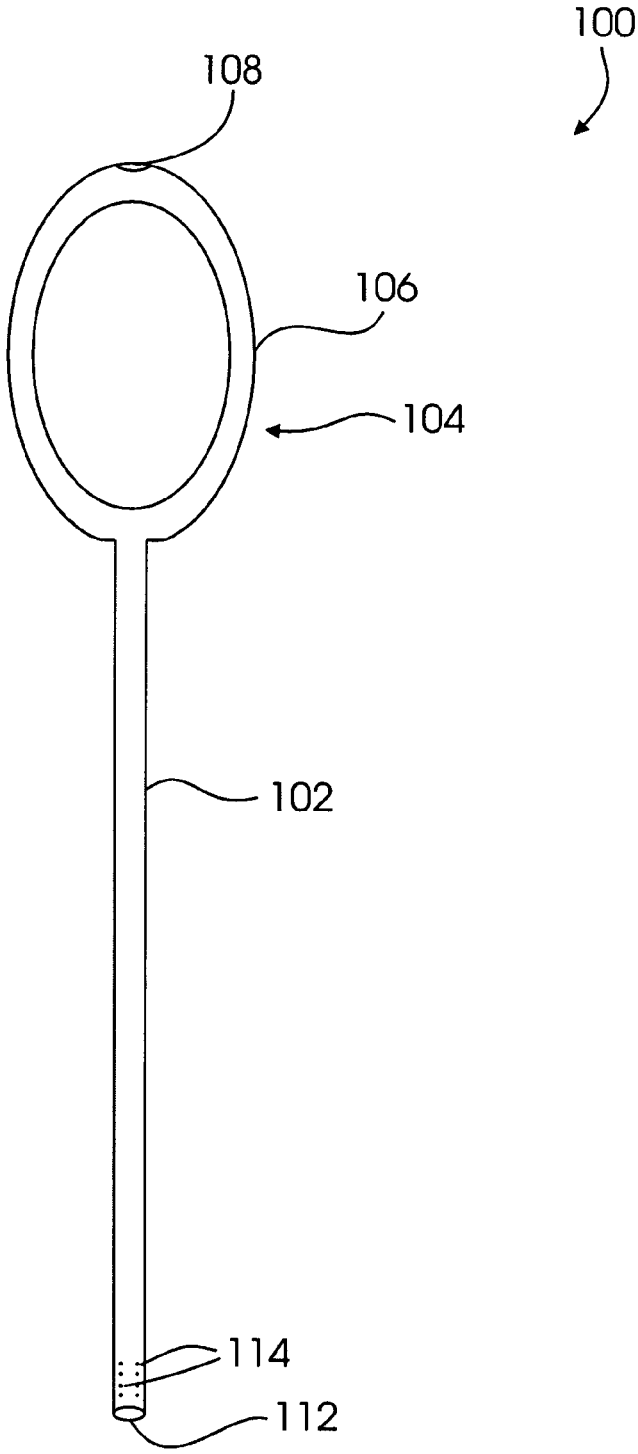
FIG. 1 is a side elevational view of the safety drinking straw of the invention.

The present invention provides a safety drinking straw. Referring first to FIG. 1, there is shown an elevational view of the elongated safety drinking straw of the invention, generally at reference number 100. Straw 100 has an elongated body 102, similar to that of drinking straws of the prior art. Straw 100 is typically formed from an extruded thermoplastic mater as is well known to those of skill in the plastic fabrication arts. However, it will be recognized that it is known to fabricate drinking straws from other materials, for example, paper. Consequently, the invention is not considered limited to the materials chosen for purposes of disclosure but covers any and all suitable materials and fabrication techniques for drinking straws.

Figure 3:
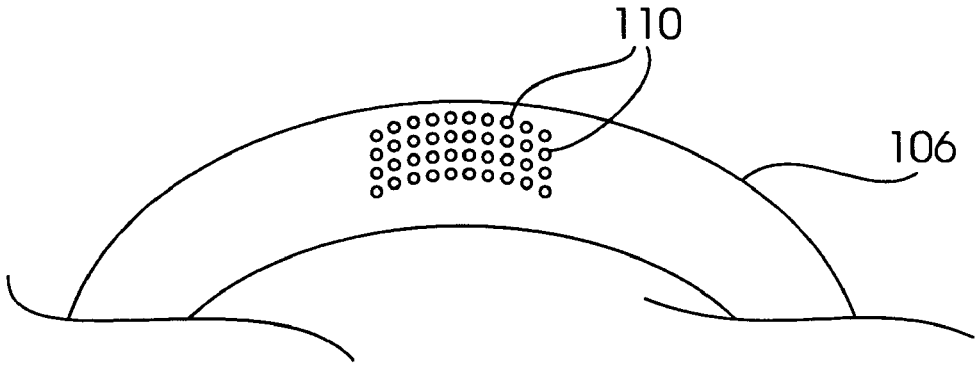
FIG. 3 is a detailed view of a lower portion of the safety drinking straws of FIGS. 1 and 2 showing a alternate upper end construction.
Figure 4:
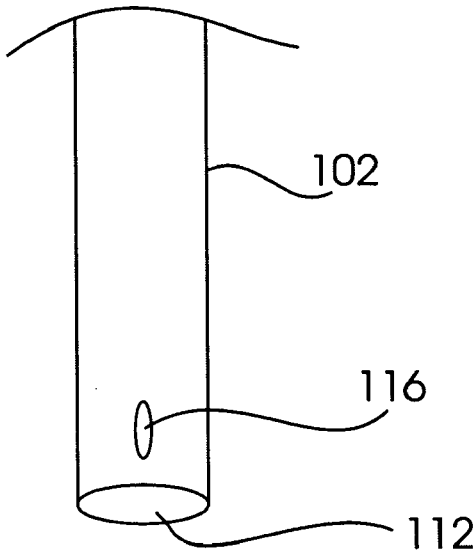
FIG. 4 is an enlarged view of an alternate embodiment of a lower portion of the straw of FIGS. 1 and 2.

An upper portion 104 of straw 100 is configured as an open loop 106 having an orifice 108 at or near its top thereof. Loop 106 may easily be grasped and manipulated by a small child or any individual having a small motor control problem. Orifice 108 may be placed at various positions along the circumference of loop 106. Orifice 108 may be a single opening or may consist of multiple, smaller openings 110 as may be seen in FIG. 3. The total opening area of orifice 108 may be selectively chosen to limit the rate of flow therethrough depending upon the intended user of the straw. For example, a straw intended for use by a young child may have a smaller orifice 108 than a straw intended for use by an adult. The size of orifice 108 may also be determined by the viscosity of the liquid, not shown, for which the straw 100 is intended.

It will be recognized that numerous different sizes, shapes, quantities, geometric arrangements, and placements of openings may be chosen to provide a discharge region for straw 100. Consequently, the invention is not limited to the particular orifice embodiments chosen for purposes of disclosure. Rather the invention covers any combination of opening sizes, shapes, quantities, geometries, and locations of openings along the perimeter of loop 106.

The distal end 112 of body 102 may, preferably be closed (i.e., sealed), thereby forcing all liquids to enter straw 100 though lower orifices 114. However, it will be recognized that in alternate embodiments, distal end 112 may be either partially or fully open.

While upper portion 104 (i.e., loop 106) is typically permanently affixed to the upper end of body 102, it is also possible to removably attach upper portion 104 to body 102. Connectors allowing such removable attachment are believed to be well known to those of skill in the art and are not further discussed herein. Any suitable connection mechanism, of course, may be used.

Figure 2:
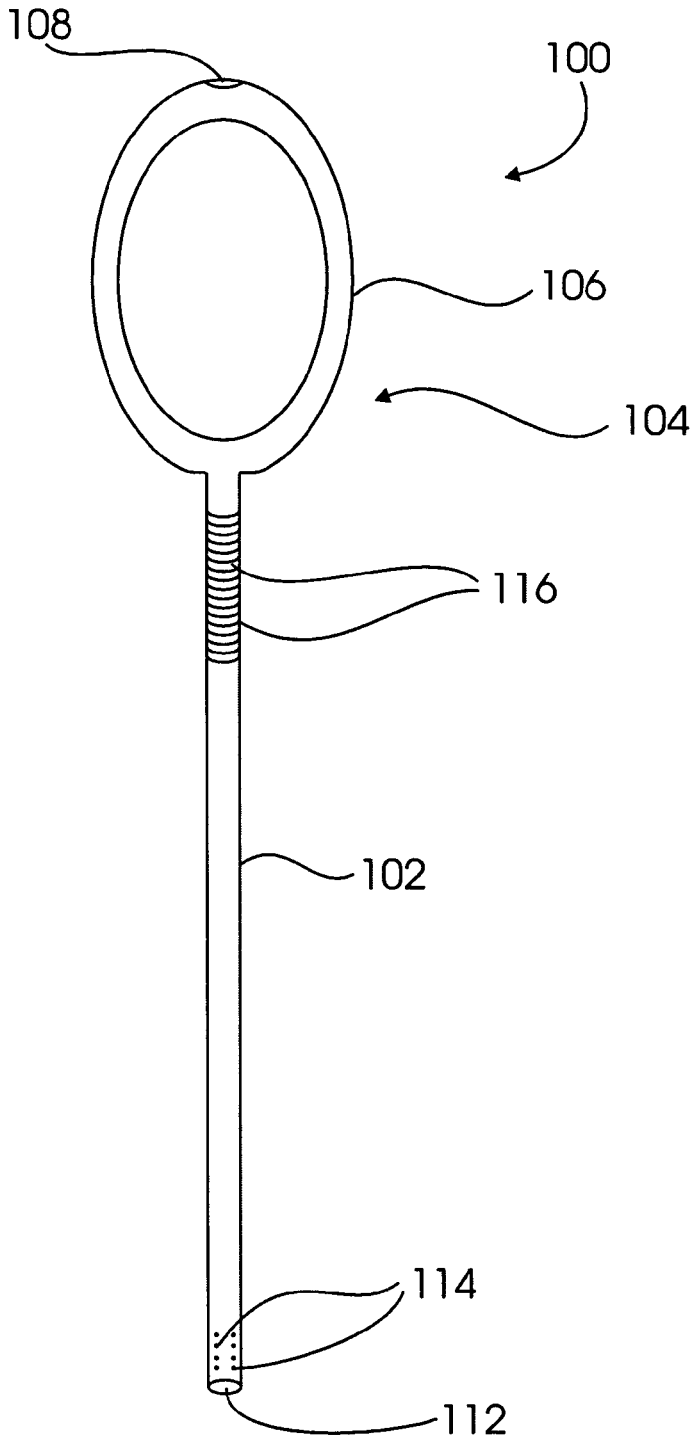
FIG. 2 is a side elevational view of and alternate embodiment of the safety drinking straw of the invention.

Referring now to FIG. 2, there is shown an elevational view of an alternate embodiment of straw 100. A series of bellows-like pleats 116 are formed in body 102 of straw 100 to allow relocation (e.g., bending) of loop 106 relative to a lower portion of body 102. Pleats 116 are typically disposed proximate loop 106 but may also be located anywhere along body 102. Such bellows-like pleats 116 are known to those of skill in the art and are not further discussed herein. It will also be recognized that other methods and constructions are known for forming flexible straws. Consequently, the invention is not considered limited to any particular mechanism of configuration for implementing flexibility but covers any and all such mechanisms and methodologies.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A safety drinking straw, comprising:

a) an elongated, hollow body having a central opening formed therethrough along a major axis thereof, said elongated body having an upper, proximal end and a lower, distal end;

b) a hollow loop disposed at said proximal end and integral with said elongated, hollow body, said hollow loop having an internal central region adapted for passing a liquid therethrough, said internal central region being contiguous with said central opening of said elongated, hollow body;

c) at least one orifice disposed at a point substantially opposite a point of connection of said hollow loop with said proximal end of said elongated body along a circumference of said hollow loop, said at least one orifice being in communication with said internal central region of said hollow loop, said hollow loop having a smooth contour in at least the region of said at least one orifice; and d) at least one lower orifice in communication with said central opening of said elongated, hollow body and disposed proximate said distal end thereof;

whereby the liquid exits said safety drinking straw in a direction parallel said major axis of said elongated, hollow body.

2. The safety drinking straw as recited in claim 1, wherein safety drinking straw comprises at least one of the materials selected from the group: plastic, and paper.

3. The safety drinking straw as recited in claim 1, wherein said distal end of said body portion is closed.

4. The safety drinking straw as recited in claim 1, further comprising:

e) means for imparting bending capability to said elongated, hollow body disposed in a central region thereof.

5. The safety drinking straw as recited in claim 4, wherein said means for imparting bending capability to said elongated, hollow body comprises a plurality of bellows-like pleats in said elongated, hollow body.

6. The safety drinking straw as recited in claim 5, wherein said plurality of bellows-like pleats is disposed proximate said proximal end of said elongated, hollow body.

7. The safety drinking straw as recited in claim 6, wherein safety drinking straw comprises at least one of the materials selected from the group: plastic, and paper.

8. The safety drinking straw as recited in claim 6, wherein said distal end of said body portion is closed.

* * * * *